US007324074B2

(12) United States Patent
Lee et al.

(10) Patent No.: US 7,324,074 B2
(45) Date of Patent: Jan. 29, 2008

(54) ELECTROLUMINESCENT DISPLAY PANEL AND METHOD FOR OPERATING THE SAME

(75) Inventors: Han Sang Lee, Kyonggi-do (KR); Myung Ho Lee, Kyonggi-do (KR); Joon Kyu Park, Seoul (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/329,473

(22) Filed: Dec. 27, 2002

(65) Prior Publication Data

US 2003/0197663 A1 Oct. 23, 2003

(30) Foreign Application Priority Data

Dec. 27, 2001 (KR) ..... 2001-86065
Dec. 29, 2001 (KR) ..... 2001-87831

(51) Int. Cl.
*G09G 3/30* (2006.01)

(52) U.S. Cl. ..... 345/76; 315/169.3

(58) Field of Classification Search ..... 345/76–81; 315/169.3; 340/825
See application file for complete search history.

(56) References Cited

U.S. PATENT DOCUMENTS

2001/0030511 A1* 10/2001 Yamazaki et al. ..... 315/160
2001/0035863 A1 11/2001 Kimura

FOREIGN PATENT DOCUMENTS

| | | |
|---|---|---|
| CN | 01122038.4 | 2/2000 |
| JP | 2000221942 A | 8/2000 |
| KR | 1020030035195 A | 5/2003 |

* cited by examiner

*Primary Examiner*—Ricardo Osorio
(74) *Attorney, Agent, or Firm*—McKenna, Long & Aldridge LLP

(57) ABSTRACT

Electroluminescent display panel and method for operating the same. The electroluminescent display panel having a plurality of unit pixels defined by a plurality of gatelines, and a plurality of sourcelines running perpendicular to each other, the unit pixel including a first switching device, a capacitor having a first terminal connected to an output terminal of the first switching device, and a second terminal connected to a power source voltage terminal, a second switching device connected to the power source voltage terminal, an electroluminescent part, and a light emission suppressing part connected to the one end of the capacitor for turning off the electroluminescent part for a preset period during a period before the present frame is operated, by receiving an enable signal that causes discharge of the capacitor and discharging a charge stored in the capacitor, thereby fabricating a high definition display.

17 Claims, 10 Drawing Sheets

ELECTROLUMINESCENT DISPLAY PANEL AND METHOD FOR OPERATING THE SAME

This application claims the benefit of the Korean Application Nos. P2001-86065 filed on Dec. 27, 2001 and P2001-87831 filed on Dec. 29, 2001, which are hereby incorporated by reference for all purposes as if fully set forth herein.

BACKGROUND OF THE INVENTION

1. Field of the Invention

The present invention relates to an electroluminescent device, and more particularly, to an electroluminescent display panel, in which an operation of an electroluminescent device is controlled, for fabricating a high definition display; and a method for operating the same.

2. Background of the Related Art

The electroluminescent device has been given attention as a next generation flat display because in comparison with a passive device which requires reception of light for displaying a picture, the electroluminescent device has advantages of a fast response speed, an excellent luminance as it is an active device, a simple structure permitting easy fabrication, light weight, and a thin and compact size.

The electroluminescent device has a wide variety of applications, such as liquid crystal display (LCD_ back lights, mobile stations, car navigation systems (CNS), notebook computers, and wall mounting type television (TV) sets.

In the electroluminescent device, there are inorganic electroluminescent devices, and organic electroluminescent devices according to a material of the electroluminescent device.

The organic electroluminescent device is a device in which a charge is injected into an organic thin layer between an electron injected electrode and a hole injected electrode, to form one pair of an electron and a hole, which collapse to emit light. The inorganic electroluminescent device is a device in which an electron accelerated by a strong field is collided with a luminescent material, to excite the luminescent material, and to make the luminescent material luminescent as the luminescent material drops down to a base state.

A related art electroluminescent display panel will be explained. FIG. 1 illustrates a circuit of unit pixel of a related art electroluminescent display panel.

Referring to FIG. 1, the unit pixel is provided with first and second switching devices 11 and 13 connected to a sourceline SL in series for switching a data signal in response to a signal applied to a gateline GL, a capacitor 15 having a first terminal connected to an output terminal of the second switching device 13, a second terminal connected to a power source terminal Vdd, for having a data voltage received through the first and second switching devices 11 and 13 charged thereto, a third switching device 17 connected between an output terminal of the first switching device 11 and the second terminal of the capacitor 15, to be controllable by the voltage induced at the first terminal of the capacitor 15, and a fourth switching device 19 connected between the power source terminal Vdd and a electroluminescent device 20, to be switchable by a voltage induced at the first terminal. The first to fourth switching devices 11, 13, 17, and 19 are PMOS transistors.

The operation of the related art electroluminescent display panel will be explained.

When an enable signal is provided to the gateline GL, and a sink current is provided to the sourceline SL, a data voltage pertinent to the signal is charged to the capacitor 15 through first and second switching devices 11 and 13.

Next, a current pertinent to the current through the third switching device 17 is provided to the electroluminescent device 20 through the fourth switching device 19, to make the electroluminescent device luminescent for a certain time period.

Thereafter, even if the gate signal that controls the first and second switching devices 11 and 13 is cut, the electroluminescent device remains luminescent as the data voltage stored in the capacitor is discharged.

However, the related art electroluminescent display panel has the following problems.

Pixel sourcelines running throughout the entire region of the electroluminescent display panel have resistance components, and there are parasitic capacitors between the gatelines and the sourcelines, resulting in requiring a long time for storing the data voltage to the capacitor 15 if a weak sink current flows to the sourceline SL to provide a data voltage pertinent to the weak sink current, in the present frame after a prior frame is finished. Accordingly, as shown in FIG. 2, blurring of the picture occurs in the present frame 2*f* after the prior frame is finished, which hinders fabrication of high definition of the electroluminescent display panel.

SUMMARY OF THE INVENTION

Accordingly, the present invention is directed to an electroluminescent display panel, and a method for operating the same that substantially obviates one or more of the problems due to limitations and disadvantages of the related art.

An advantage of the present invention is to provide an electroluminescent display panel, and a method for operating the same, in which a data voltage can be charged to a capacitor quickly for displaying a high definition picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electroluminescent display panel having a plurality of unit pixels defined by a plurality of gatelines, and a plurality of sourcelines running perpendicular to each other, the unit pixel including a first switching device responsive to a signal applied to the gateline for switching a data signal, a capacitor having a first terminal connected to an output terminal of the first switching device, and a second terminal connected to a power source voltage terminal, for having a data voltage provided thereto through the first switching device and charged thereto, a second switching device connected to the power source voltage terminal for being switched by a voltage induced at the first terminal of the capacitor, an electroluminescent part for emitting a light by the power source voltage provided through the second switching device, and a light emission suppressing part connected to the one end of the capacitor for turning off the electroluminescent part for a preset period during a period before the present frame is operated, by receiving an enable signal that causes discharge of the capacitor and discharging a charge stored in the capacitor.

The first switching device, the second switching device, or the light emission suppressing part includes a PMOS transistor.

The light emission suppressing part is connected in parallel with the capacitor.

The light emission suppressing part may be connected between a first terminal and a second terminal of the capacitor, or between an output terminal of the first switching device and an output terminal of the second switching device.

The enable signal is provided from the light emission suppress drive part which makes to provide a low level pulse to the plurality of gatelines before application of the enable signal.

The enable signal is a signal enabled by a front end gateline of the plurality of gatelines.

The electroluminescent display panel further including a third switching device between the second switching device and the electroluminescent part operative in response to the enable signal.

The third switching device includes an NMOS transistor.

In another aspect of the present invention, there is provided a method for operating an electroluminescent display panel having a plurality of unit pixels each defined by gatelines and sourcelines, both arranged to cross each other, first and second switching devices, a capacitor, an electroluminescent part, and a light emission suppressing part, including providing an erase signal to the light emission suppressing part for discharging a voltage charged in the capacitor of a prior frame before the present frame is operative, and applying an enable signal to the gateline, and applying a data voltage to the sourceline, for charging the data voltage to the capacitor through the first switching device, and turning on the second switching device to provide a power source voltage to the electroluminescent part to make the electroluminescent part to emit a light for a time period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the embodiments of the present invention, examples of which are illustrated in the accompanying drawings.

First Embodiment

Figure 1:
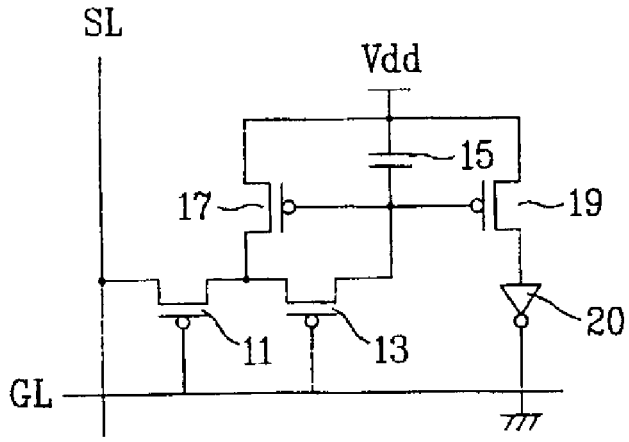
FIG. 1 Related Art
FIG. 1 illustrates a circuit of unit pixel of a related art electroluminescent display panel.
Figure 2:
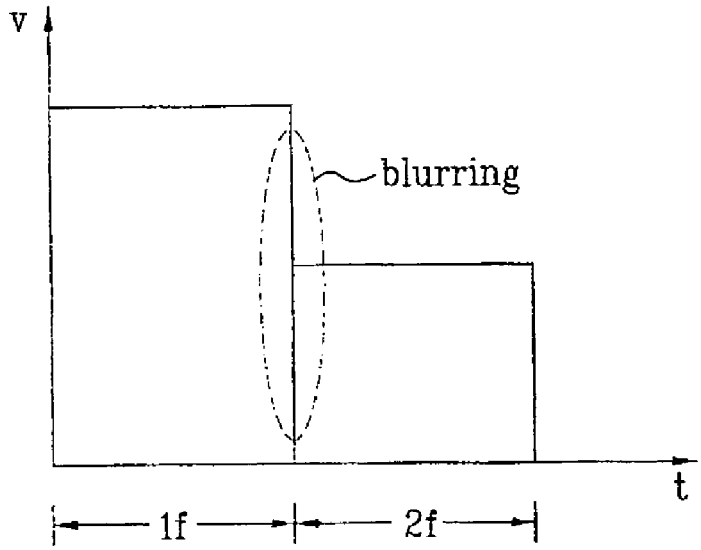
FIG. 2 Related Art
FIG. 2 illustrates a timing diagram for explaining a problem of the related art electroluminescent display panel.
Figure 3:
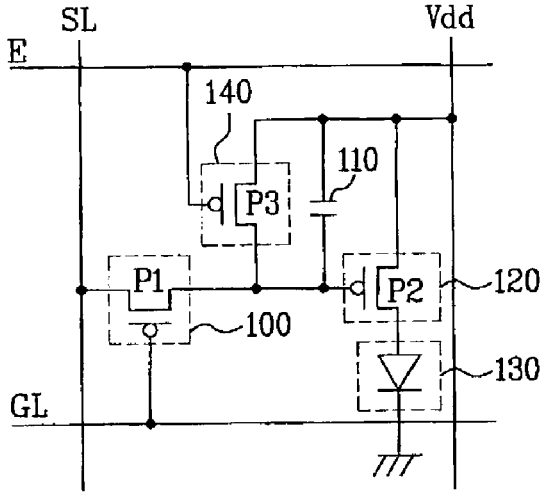
FIG. 3 illustrates a circuit of an electroluminescent display panel in accordance with a first referred embodiment of the present invention.
Figure 4:
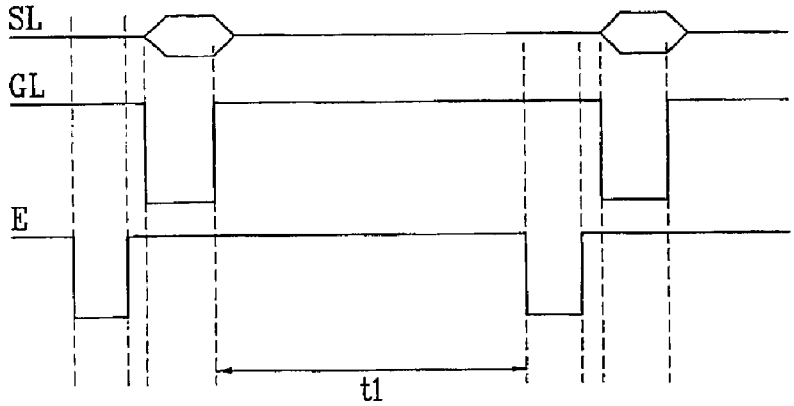
FIGS. 4 and 5 illustrate operative time diagrams of FIG. 3.
Figure 5:
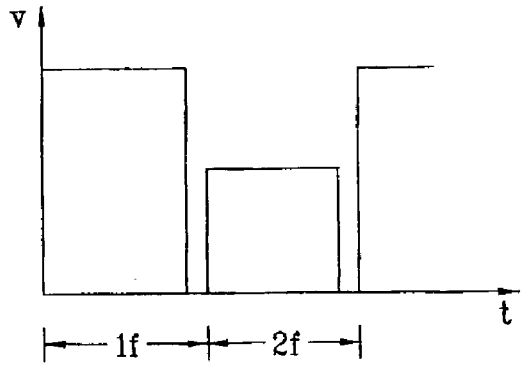
Figure 6:
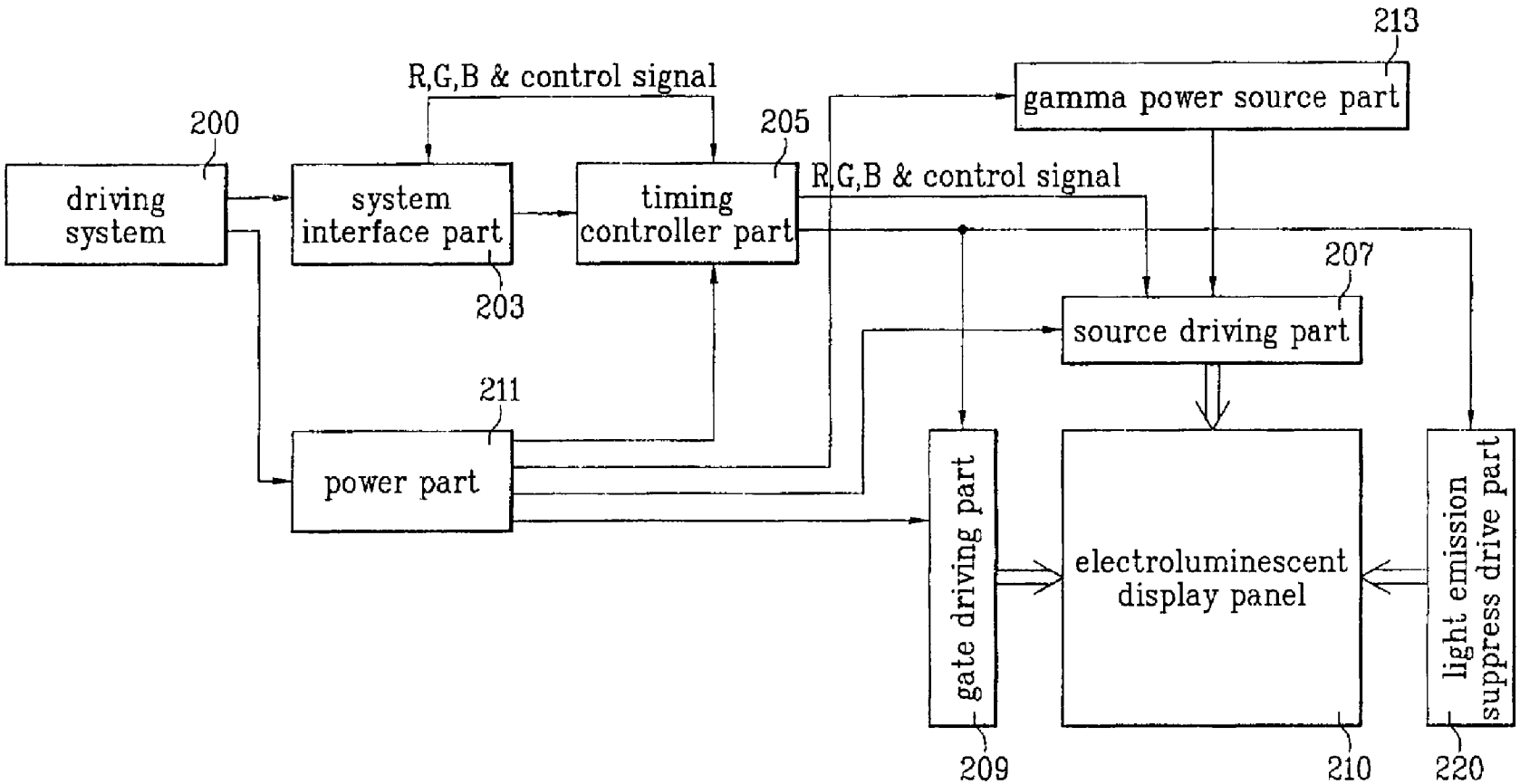
FIG. 6 illustrates a block diagram of an electroluminescent display panel inclusive of the unit pixel in FIG. 3.

FIG. 3 illustrates a circuit of an electroluminescent display panel in accordance with a first embodiment of the present invention. FIGS. 4 and 5 illustrate operative time diagrams of FIG. 3. FIG. 6 illustrates a block diagram of an electroluminescent display panel inclusive of the unit pixel in FIG. 3.

Referring to FIG. 3, a plurality of unit pixels are provided, which are defined at every crossing part of a plurality of gatelines GL and sourcelines SL running perpendicular to the gatelines. Only one unit cell is shown in the drawing.

The unit cell of the electroluminescent display panel in accordance with a first embodiment of the present invention includes a first switching device 100 for switching a data signal in response to a signal provided to the gateline GL, a capacitor 110 having a first terminal connected to an output terminal of the first switching device 100, and a second terminal connected to a power source terminal Vdd for having a data voltage received through the first switching device 100 charged thereto, a second switching device 120 connected to the power source terminal for being switched by a voltage induced at the first terminal of the capacitor, an electroluminescent part 130 for emitting light by a voltage from the power source through the second switching device 120, and a light emission suppressing part 140 for turning off the electroluminescent part 130 for a preset time period by receiving an enable signal E' which makes the capacitor 110 to discharge for a preset time period before the present frame and making a charge stored in the capacitor of a prior frame discharged.

The first and second switching devices 100 and 120, and the light emission suppressing part 140 include PMOS transistors P1, P2, and P3, respectively.

The light emission suppressing part 140 is connected between the first terminal and the second terminal of the capacitor 110 in parallel with the capacitor 110. The light emission suppressing part 140 prevents a discharge voltage of the capacitor 110 from transmitting to the electroluminescent part 130 in response to an enable signal generated by the light emission suppress drive part (not shown) which provides a fixed low level pulse before an enable signal is provided to each of the plurality of gatelines.

Figure 15:
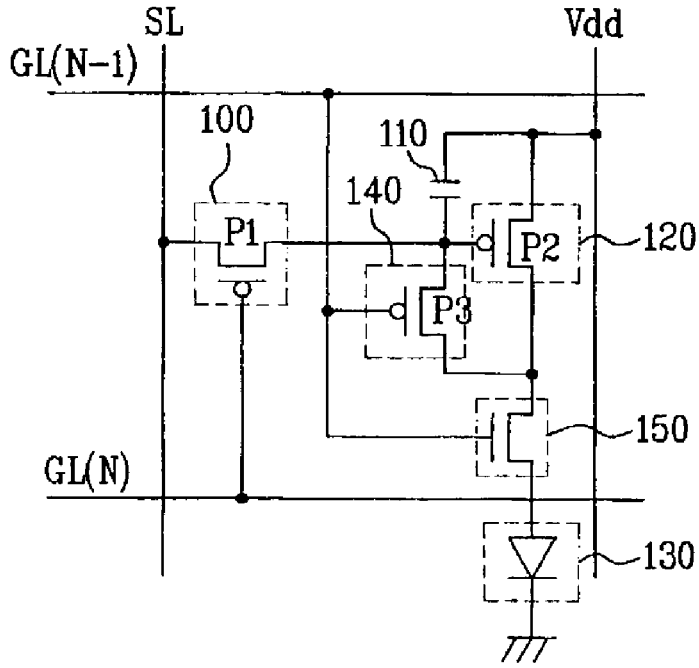

The light emission suppressing part 140 is applicable to the related art electroluminescent display panel with four thin film transistors (TFTs) also, i.e., the light emission suppressing part 140 is connected between the first and second terminals of the capacitor 15 (see FIG. 15) and a separate enable signal E is applied to the light emission suppressing part 140 for driving the light emission driving part 140.

The operation of the electroluminescent display panel having the foregoing unit pixel will be explained, with reference to a timing diagram.

Referring to FIGS. 4 and 5, before operation of the present frame, i.e., before the gate signal is enabled, if the light emission suppress drive part (not shown) provides an erase signal E to the light emission suppressing part 140 on both sides of the capacitor 110, a voltage charged in the capacitor 110 in a prior frame is discharged fully, such that the electroluminescent part 130 does not emit any more light from the light emission suppressing part 140.

Then, when the present frame is operated, i.e., when an enable signal is provided to the gateline GL, and a data voltage is provided to the sourceline SL, the data voltage is charged in the capacitor 110 through the first switching device 100 and turns on the second switching device 120, such that a power is provided from the power source terminal Vdd to the electroluminescent part 130, to make the electroluminescent part 130 luminescent.

Referring to FIG. 5, according to above operation, the data voltage stored in the capacitor 110 in the prior frame 1*f* is discharged fully during a certain period after operation of the prior frame 1*f*, but before operation of the present frame 2*f*, to prevent the electroluminescent part 130 from emitting light, thereby suppressing the blurring of the picture, to improve the picture quality.

When it is assumed that a time period from a time point the electroluminescent part 130 starts to emit light to a time point the erase signal E is provided before the next frame is t1, adjustment of luminance can be made by adjusting t1 which in turn adjusts a light emission period of the electroluminescent part 130.

Moreover, when it is required to drive the electroluminescent part 130 in a low power mode, t1 is made short, for an effective low power mode operation which matching an overall gray balance.

An entire system of the electroluminescent display panel of the foregoing unit pixel will be explained.

Referring to FIG. 6, the electroluminescent display panel includes a system interface part 203 for inducing application of red, green, blue (R, G, B) signals, data signals from a driving system 200, to the electroluminescent display panel 210, a timing controller part 205 for receiving the data signal from the system interface part 203 and producing different control signals and data for stable operation of the electroluminescent display panel 210, a source driving part 207 for converting the data signal from the timing controller part 205 into analog signal, and applying the data signal to the sourcelines SL of the electroluminescent display panel 210, a gate driving part 209 for receiving a display control signal from the timing controller part 205, and applying a pulse voltage to the gatelines, a power part 211 for receiving a power from the driving system 200 and applying required power to respective parts, a gamma power source part 213 for receiving a power branched from the power part 211 for producing a reference voltage required for the digital/analog conversion of the source driving part 207, and a light emission suppress drive part 220 for controlling the light emission suppressing part 140 which turns off the electroluminescent part 130 in the foregoing unit pixel for a preset time period under the control of the timing controller part 205.

Second Embodiment

Figure 7:
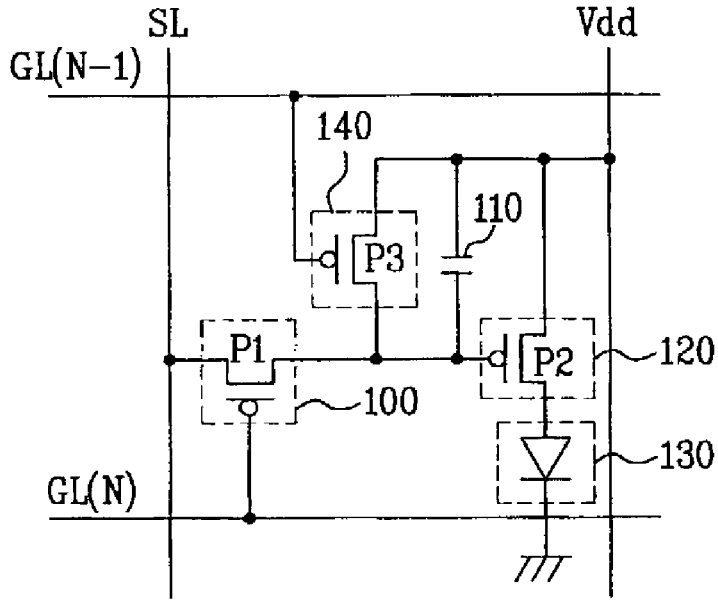
FIG. 7 illustrates a circuit in accordance with a second embodiment of the present invention.
Figure 8:
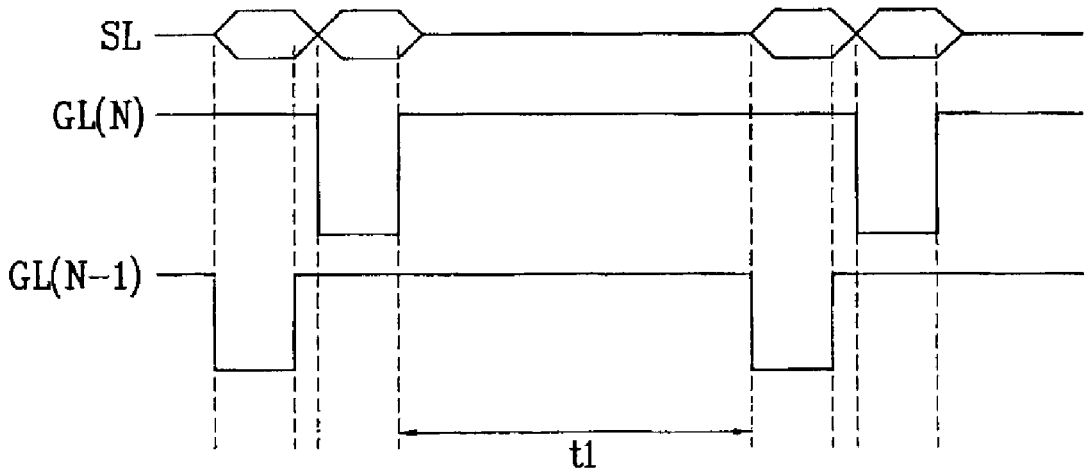
FIG. 8 illustrates an operative time diagram of FIG. 7.
Figure 9:
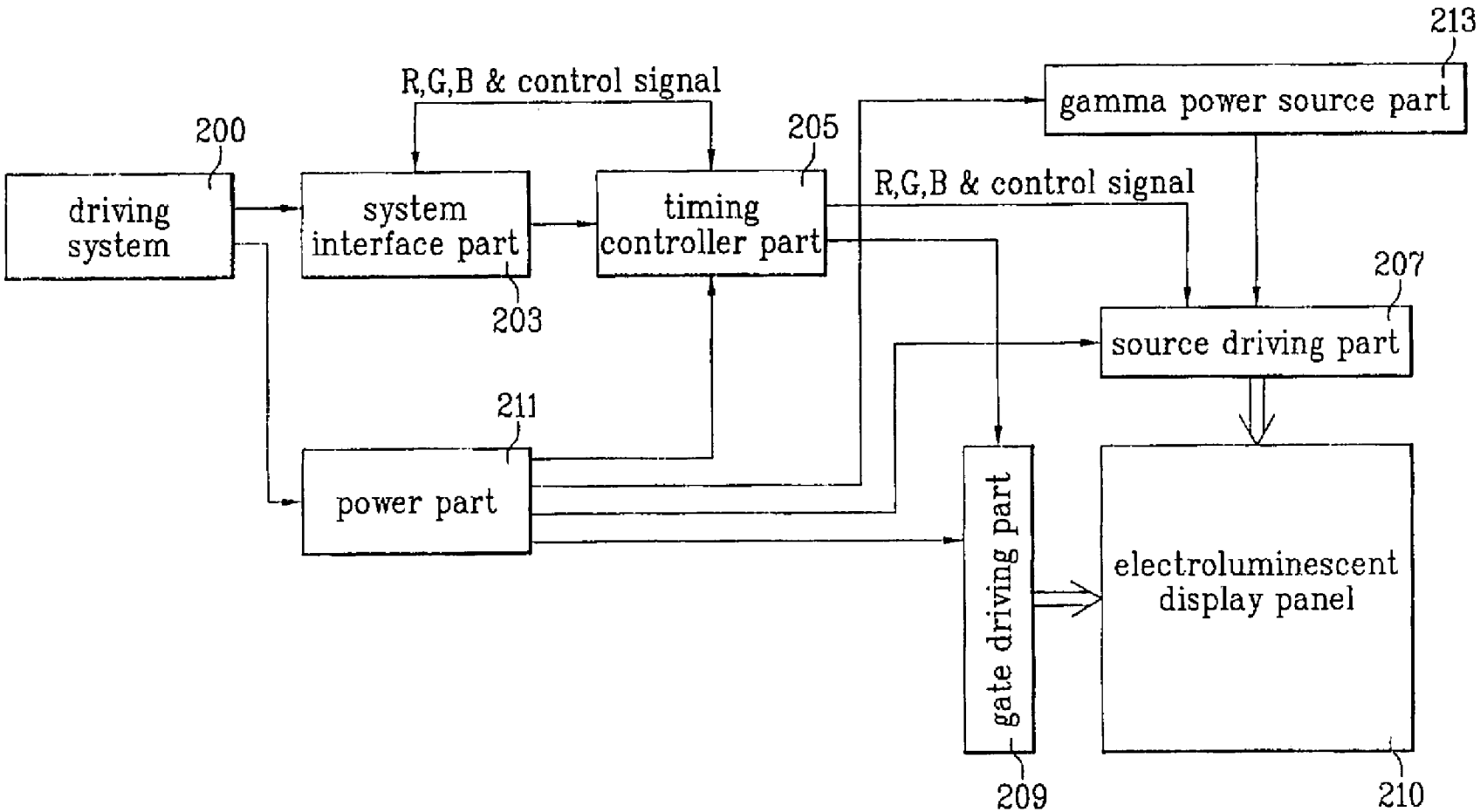
FIG. 9 illustrates a block diagram of an electroluminescent display panel inclusive of the unit pixel in FIG. 7.

FIG. 7 illustrates a circuit in accordance with a second embodiment of the present invention. FIG. 8 illustrates an operative time diagram of FIG. 7. FIG. 9 illustrates a block diagram of an electroluminescent display panel inclusive of the unit pixel in FIG. 7.

The second embodiment of the present invention is characterized in that an erase signal E, an enable signal of the light emission suppressing part 140, is enabled by a front gateline GL(N−1) of a plurality of gatelines GL(N). That is, the light emission suppress drive part 220 is not required for controlling the light emission suppressing part 140, but the light emission suppress part 140 is controlled for itself in initializing the capacitor 110.

The light emission suppressing part 140 in the second embodiment is applicable to the related art electroluminescent display panel with four TFTs also, i.e., the light emission suppressing part 140 is connected between the first and second terminals of the capacitor 15 (see FIG. 15) and a separate enable signal E is applied to the light emission suppressing part 140 for driving the light emission driving part 140.

The operation of the electroluminescent display panel of the present invention will be explained, with reference to FIG. 8.

Referring to FIG. 8, when a gateline GL(N−1) of a prior stage is enabled, a video signal is stored in a pixel connected to the gateline GL(N−1).

Then, referring to FIG. 8, the pixel connected to the gateline GL(N) drives the light emission suppressing part 140, to discharge the voltage stored in the capacitor 110 of a prior frame fully, to initialize the capacitor 110.

Then, when the gateline GL(N) is enabled and the data voltage is provided to the sourceline SL, the data voltage is charged to the capacitor 110 through the first switching device 100, and, at the same time, turns on the second switching device 120 such that the electroluminescent part 130 emits light for a time period as a power is provided thereto from the power source terminal VDD.

FIG. 9 illustrates a block diagram of an electroluminescent display panel of the unit pixel in FIG. 7, wherefrom the light emission suppress drive part 220 in FIG. 6 is omitted. That is, the erase signal 'E', an enable signal form the light emission suppressing part 140, is enabled by a front end gateline GL(N−1) of the plurality of gatelines GL(N), the light emission suppress drive part 220 shown in FIG. 6 is not required.

Third Embodiment

Figure 10:
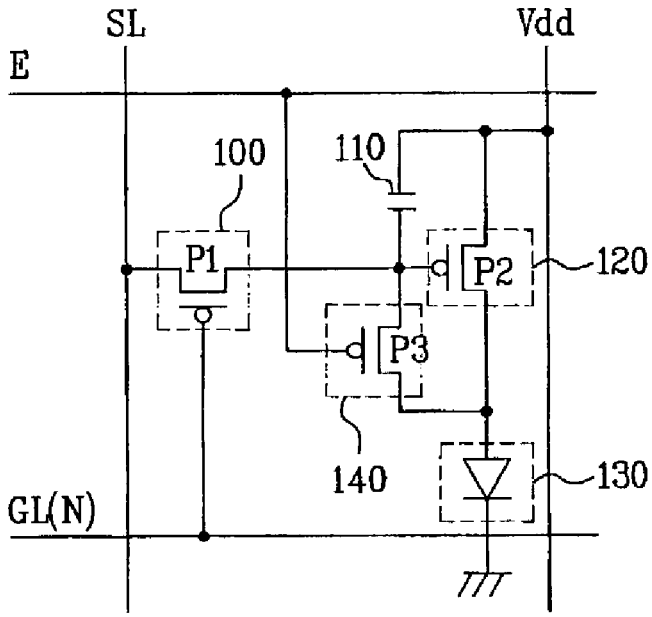
FIGS. 10~15 illustrate circuits in accordance with one of a third to eighth embodiments of the present invention.

FIG. 10 illustrates a circuit in accordance with a third embodiment of the present invention, of which timing diagram is the same with FIG. 4.

Referring to FIG. 10, the electroluminescent display panel in accordance with a third embodiment of the present invention is identical to the first embodiment, except that the light emission suppressing part 140 is connected between an output terminal of the first switching device 100 and an output terminal of the second switching device 120.

In the electroluminescent display panel, before the present frame is operated, i.e., before the gate signal is enabled, if the light emission suppress drive part (not shown) provides an erase signal E to the light emission suppressing part 140, the light emission drive part 140 comes into operation, to initialize a data voltage stored in the capacitor 110 of a prior frame to a value in the vicinity of a threshold voltage of the second switching device 120, thereby suppressing the light emission of the electroluminescent part 130.

Then, when the present frame is operated, i.e., when the gateline GL is enabled and a data voltage, for an example, a video signal with a low luminance, is provided to the sourceline SL, though the charging to the capacitor takes a long time period in the related art, the data voltage can be charged to the capacitor 110 quickly in the embodiment of the present invention, thereby permitting fabrication of a high definition electroluminescent display panel.

The electroluminescent suppressing part 140 in accordance with a third embodiment of the present invention is applicable to the related art electroluminescent display panel having 4-TFT structure.

Fourth Embodiment

Figure 11:
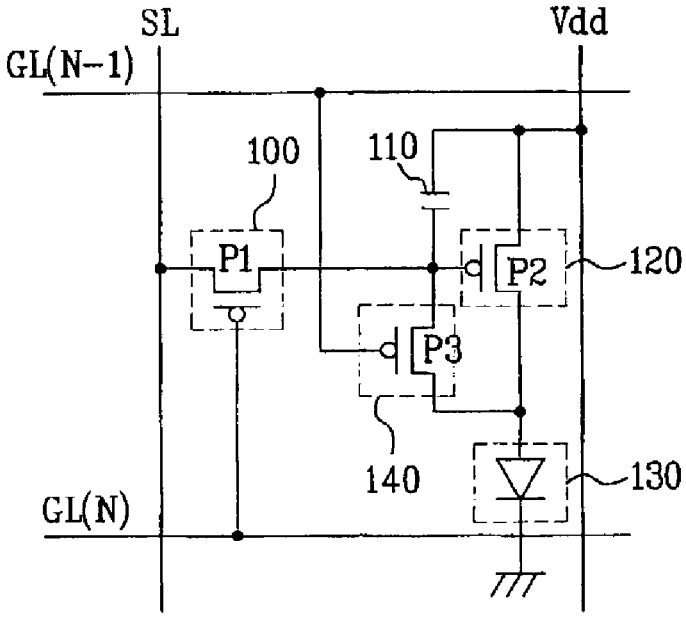
Figure 12:
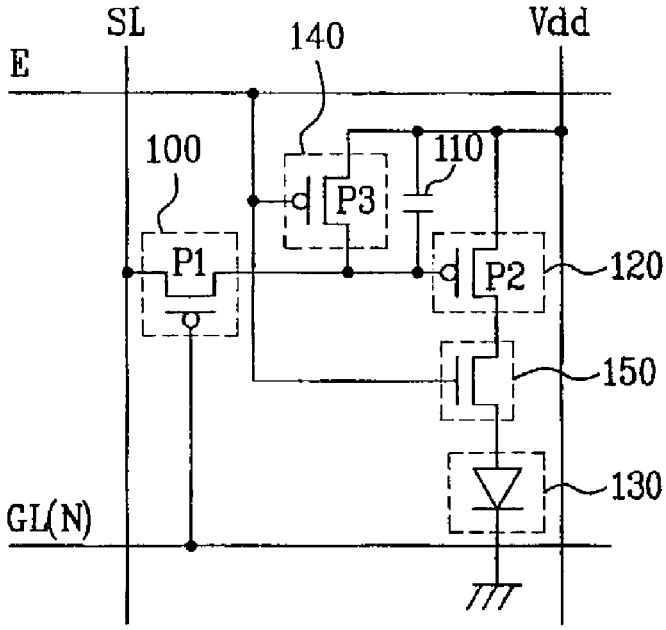
Figure 13:
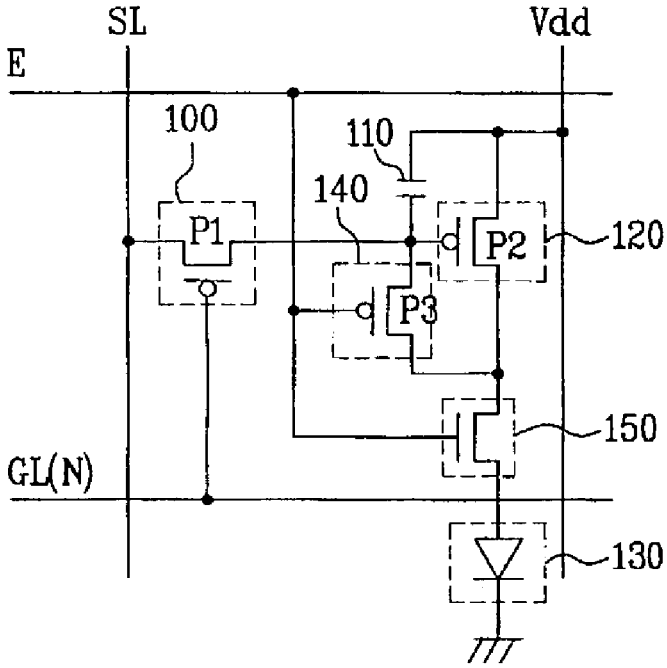
Figure 14:
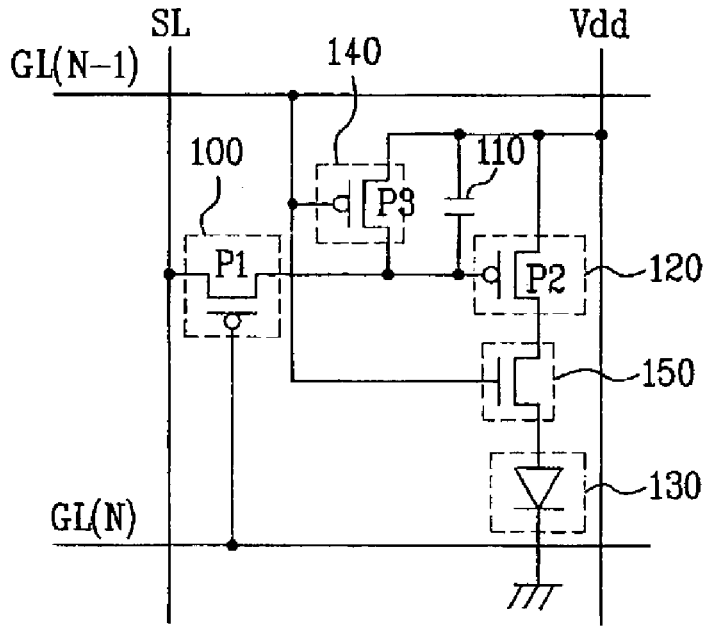

FIG. 11 illustrates a circuit in accordance with a fourth embodiment of the present invention, of which timing diagram is the same with FIG. 8.

Referring to FIG. 11, the fourth embodiment is a combination of the embodiments explained in association with FIGS. 7 and 10.

That is, the light emission suppressing part 140 is connected between an output terminal of the first switching device 100 and an output terminal of the second switching device 120, and the erase signal E, an enable signal from the light emission suppressing part 140, is enabled by a front end gateline GL(N−1) of a plurality of gatelines GL(N).

The light emission suppressing part 140 in the fourth embodiment is applicable to the related art electroluminescent display panel with four TFTs, also.

Fifth to Eighth Embodiments

FIGS. 12~15 illustrate circuit diagrams in accordance with fifth to eighth embodiments of the present invention, respectively.

The electroluminescent display panel in accordance with fifth to eighth embodiments of the present invention further include third switching device to the electroluminescent display panel in accordance with first to fourth embodiments of the present invention, respectively.

The third switching device 150 is driven in response to a signal 'E' or GL(N−1)' the same with the light emission suppressing part 140, and fitted between the second switching device 120 and the electroluminescent part 130.

The third switching device 150 is an NMOS transistor, for being turned off when the light emission suppressing part is driven, and for being turned on when the light emission suppressing part 140 is not driven, for more effective control of the electroluminescent part 130.

The light emission suppressing part 140 and the third switching device in one of the fifth to eight embodiments is applicable to the related art electroluminescent display panel with four TFTs, also.

Another Embodiment of the Operating Method

Figure 16:
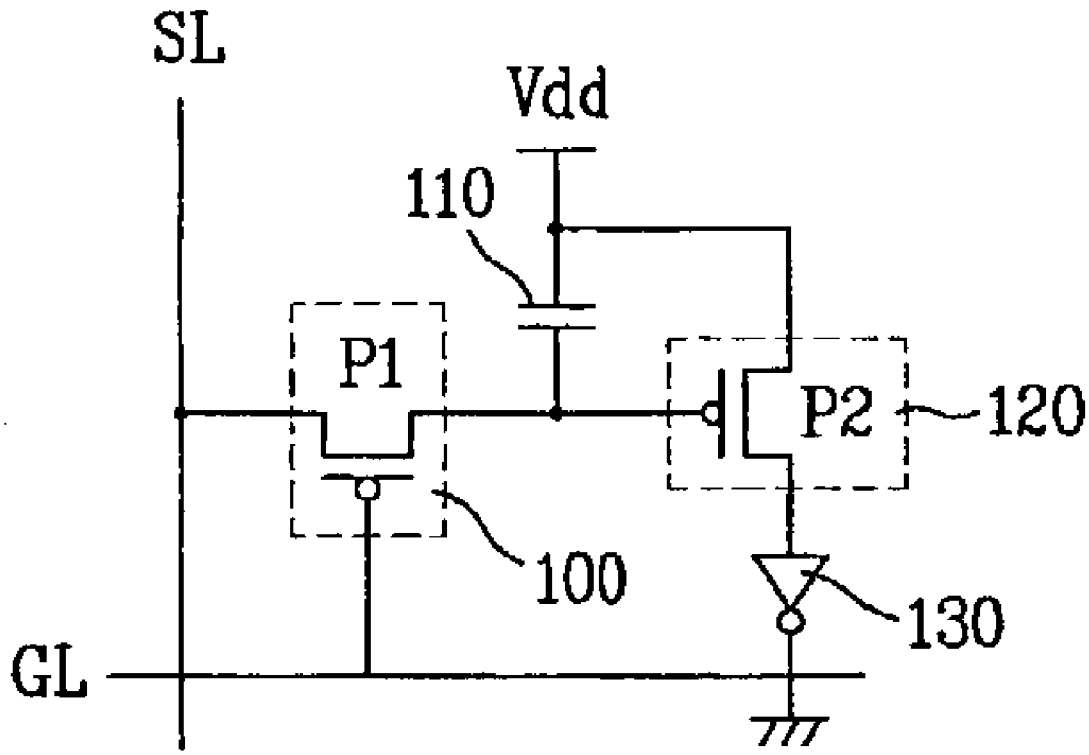
FIG. 16 illustrates a circuit for applying an operating method in accordance with another embodiment of the present invention.
Figure 17:
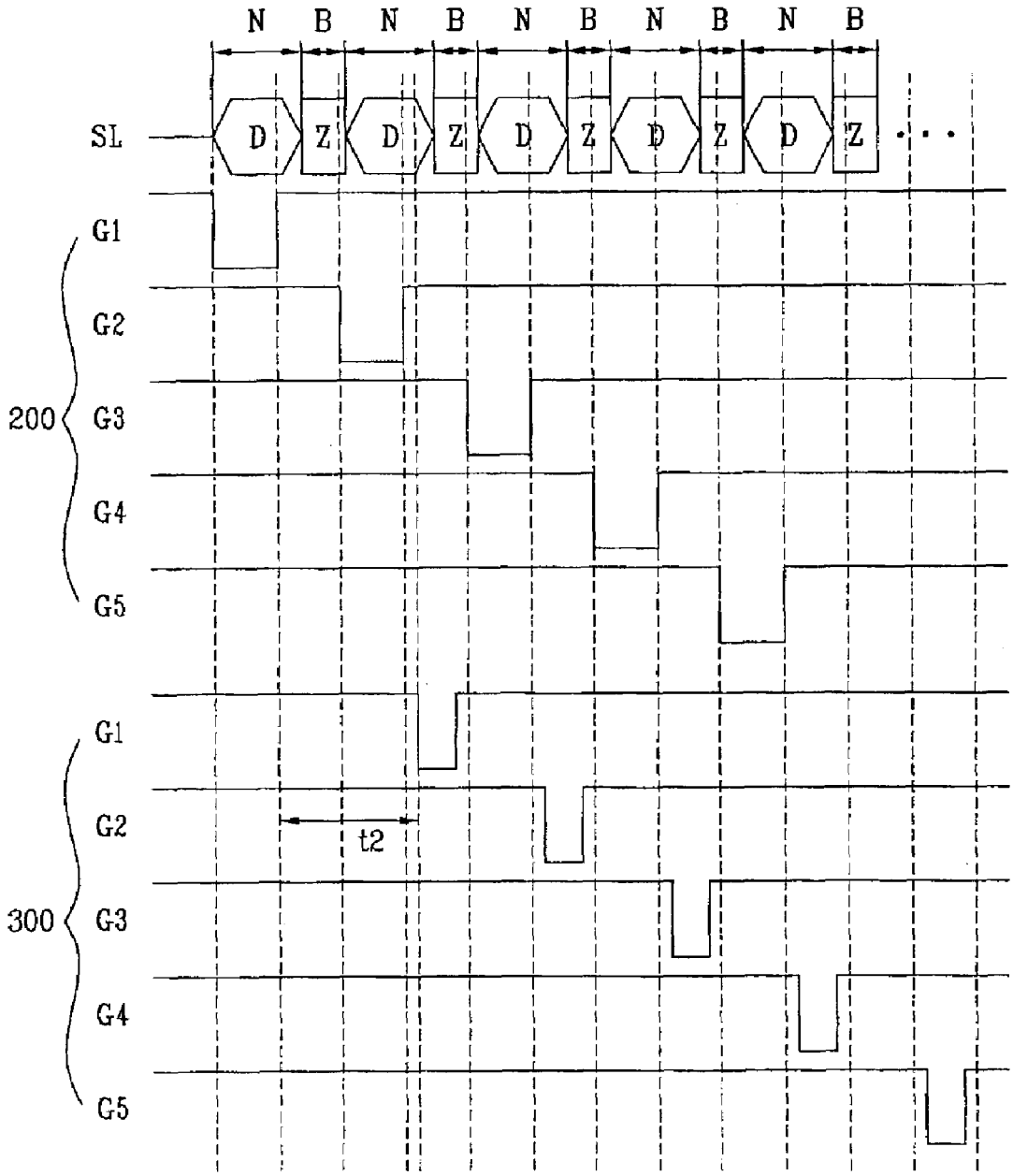
FIG. 17 illustrates an operative timing diagram for explaining a method for operating an electroluminescent display panel by using the circuit in FIG. 16 in accordance with the present invention.

FIG. 16 illustrates a circuit for applying an operating method in accordance with another embodiment of the present invention. FIG. 17 illustrates an operative timing diagram for explaining a method for operating an electroluminescent display panel by using the circuit in FIG. 16 in accordance with the present invention.

Referring to FIG. 16, the electroluminescent display panel for applying the another embodiment operating method of the present invention includes a matrix of a plurality of unit pixels defined by a plurality of gatelines GL running in a horizontal direction and a plurality of sourcelines SL running in a vertical direction to cross the gatelines GL.

Only one unit pixel is shown in the drawing. Though not shown, there are a gate driving part at a side of the electroluminescent display panel for enabling the gatelines GL, a data driving part on the panel for enabling the datalines SL, and a timing controller part for providing signals for enabling the gate driving part and the data driving part.

The electroluminescent display panel includes a first switching device 100 for switching the data signal in response to a signal provided to the gateline GL in the unit pixel, a capacitor 110 having a first terminal connected to an output terminal of the first switching device 100, and a second terminal connected to a power source terminal Vdd, for being charged by a data voltage received through the first switching device 100, a second switching device 120 connected to the power source terminal for being switched by a voltage induced at the first terminal of the capacitor 110, and an electroluminescent part 130 for emitting a light by a voltage through the second switching device 120.

The first, and second switching devices 100 and 200 are PMOS transistors P1 and P2, respectively.

A method for operating an electroluminescent display panel of the present invention explained hereafter is by using a circuit in FIG. 16 which has no separate light suppressing part. Operation of the electroluminescent display panel having a unit pixel as shown in FIG. 16 will be explained, with reference to a timing diagram.

Referring to FIG. 17, in application of a data voltage, i.e., a video picture signal to the sourceline SL, a normal period 'N' and a black data period 'B' are designated, and a real data voltage 'D' is applied to the normal period 'N', and a black data voltage 'Z' is applied to the black data period 'B'.

The normal period 'N' and the black data period 'B' may be set up by timing control of the timing controller (not shown) which provides signals required for the gate driving part and the data driving part.

The black data voltage 'Z', for turning off the second switching device 120, is a voltage that can discharge the capacitor 110 at fixed intervals, preferably in a range from (a power source voltage—a threshold voltage of the second switching device) to (the power source voltage).

The operation will be explained in more detail. The gate driving part provides gate signals G1~G5 to the plurality of gatelines GL progressively for turning on the first switching devices 100, and the data driving part provides a real data signal 'D' to the electroluminescent display panel through the first switching devices 100 driven by the gate signals G1~G5. Then, as a charge for the real data signal D is charged to the capacitor 110, the second switching device 120 is turned on, to make the electroluminescent part 130 to emit a light for a time period.

In the method for operating an electroluminescent display panel in accordance with a preferred embodiment of the present invention, every frame is divided into a normal period 'N' and a black data period 'B', to which a real data voltage 'D' and a black data voltage 'Z' are applied.

Each of the gate signals G1~G5 is divided into a first gate signal 200 and a second gate signal 300, and loaded on the gateline GL, and the first gate signal 200 is applied to the normal period 'N' and the second gate signal 300 is applied to the black data period 'B'.

The real data voltage D is applied to the sourceline in the normal period N and the black data voltage Z is applied to the sourceline in the black data period B. The electroluminescent display panel displays a picture while turning off the electroluminescent part 130 repeatedly at fixed intervals.

When it is assumed that a time period from a time point the electroluminescent part 130 starts to emit a light, i.e., a time point the first gate signal 200 is applied, to a time point the electroluminescent part 130 is turned off, i.e., the second gate signal is applied, is t2, a luminance control is possible by controlling the time period t2, that in turn controls a light emitting time period of the electroluminescent part 130.

When it is required to drive the electroluminescent part 130 in a low power mode, the t2 time period is controlled to be short, for making an effective low power mode driving while matching an overall gray scale balance.

As has been explained, the electroluminescent display panel, and a method for operating the same of the present invention have the following advantages.

First, by preventing light emission of the electroluminescent part 130 by full discharge of the data voltage stored in the capacitor 110 of a prior frame during a period after operation of the prior frame 1*f*, but before the operation of the present frame 2*f*, blurring on the screen can be suppressed, thereby improving a picture quality.

Second, the controlling of a light emission period of the electroluminescent part 130 by controlling a time period t1 until an erase signal E is provided before the next frame permits control of a luminance.

Third, when a low power mode driver of the electroluminescent part 130 is required, the t1 time period is controlled to be short, for making an effective low power mode drive while matching an overall gray scale balance.

A high definition electroluminescent display panel can be fabricated, which can make the capacitor charges a data voltage quickly and display if a video signal with a low luminance is provided in the present frame.

It will be apparent to those skilled in the art that various modifications and variations can be made in the device for controlling spreading of liquid crystal, and method for fabricating an LCD of the present invention without departing from the spirit or scope of the invention. Thus, it is intended that the present invention cover the modifications and variations of this invention provided they come within the scope of the appended claims and their equivalents.

What is claimed is:

1. An electroluminescent display panel having a plurality of unit pixels defined by a plurality of gatelines, and a plurality of sourcelines running perpendicular to the plurality of gatelines, the unit pixel comprising:

a first switching device responsive to a signal applied to a gateline for switching an analog data signal applied to a sourceline;

a capacitor having a first terminal connected to an output terminal of the first switching device, and a second terminal connected to a power source voltage terminal, for having the analog data signal provided thereto through the first switching device and charged thereto;

a second switching device connected to the power source voltage terminal for being switched by a voltage induced at the first terminal of the capacitor;

an electroluminescent part for emitting a light by the power source voltage provided through the second switching device;

a light emission suppressing part connected to one end of the capacitor for turning off the electroluminescent part for a preset period during a period before a present frame is operated, by receiving an enable signal that causes discharge of the capacitor and discharging a charge stored in the capacitor; and a third switching device connected between an output terminal of the second switching device and the electroluminescent part, the third switching device is driven in response to the enable signal the same as the light emission suppressing part.

2. An electroluminescent display panel as claimed in claim 1, wherein the first switching device, the second switching device, and the light emission suppressing part includes a first type transistor.

3. An electroluminescent display panel as claimed in claim 2, wherein the first type transistor is a PMOS transistor.

4. An electroluminescent display panel as claimed in claim 1, wherein the light emission suppressing part is connected in parallel with the capacitor.

5. An electroluminescent display panel as claimed in claim 1, wherein the light emission suppressing part is connected between a first terminal and a second terminal of the capacitor.

6. An electroluminescent display panel as claimed in claim 1, wherein the light emission suppressing part is connected between an output terminal of the first switching device and an output terminal of the second switching device.

7. An electroluminescent display panel as claimed in claim 1, wherein the enable signal is provided from a light emission suppress drive part which provides a low level pulse to the plurality of gatelines before application of the enable signal.

8. An electroluminescent display panel as claimed in claim 1, wherein the enable signal is a signal enabled by a front end gateline of the plurality of gatelines.

9. An electroluminescent display panel as claimed in claim 1, wherein the third switching device includes a second type transistor.

10. An electroluminescent display panel as claimed in claim 9, wherein the second type transistor is an NMOS transistor.

11. A method for operating an electroluminescent display panel having a plurality of unit pixels each defined by gatelines and sourcelines, the gatelines and sourcelines arranged to cross each other, first and second switching devices, a capacitor, an electroluminescent part, and a light emission suppressing part, the method comprising:

providing an erase signal to a third switching device and the light emission suppressing part for discharging an analog data signal charged in the capacitor during a prior frame before a present frame is operative, the light emission suppressing part connected to one end of the capacitor, and the third switching device connected between an output terminal of the second switching device and the electroluminescent part; and applying an enable signal to the gatelines and applying an analog data signal to sourcelines, for charging the analog data signal to the capacitor through the first switching device, and turning on the second switching device to provide a power source voltage to the electroluminescent part to make the electroluminescent part to emit a light for a time period.

12. A method as claimed in claim 11, wherein the first and second switching devices are PMOS transistors.

13. A method for operating an electroluminescent display panel having a plurality of unit pixels, gatelines and sourcelines, the gatelines and the sourcelines arranged to cross each other, a first switching device for switching an analog data signal provided to the sourcelines in response to a signal provided to the gatelines, a capacitor for having the analog data signal provided through the first switching device and charged thereto, a second switching device connected to a power source voltage terminal for being switched by a voltage induced at the capacitor, an electroluminescent part for emitting a light by a power source voltage provided through the second switching device, the method comprising:

dividing a frame into a normal period and a black period;

applying an analog real data signal to the sourcelines during the normal period and applying an analog black data signal to the sourcelines during the black period;

enabling gatelines of the plurality of unit pixels progressively in the normal period and the black period; and in the enabling of the gatelines, applying the analog black data signal to the gatelines during the black period, for displaying a picture while turning off the electroluminescent part repeatedly at fixed intervals.

14. A method as claimed in claim 13, wherein the gate signal is loaded on the gatelines, with the gate signal divided into a first gate signal and a second gate signal.

15. A method as claimed in claim 14, wherein the first gate signal is applied during the normal period, and the second gate signal is applied during the black period.

16. A method as claimed in claim 13, wherein the analog black data signal is a voltage for turning off the second switching device.

17. A method as claimed in claim 16, wherein the analog black data signal ranges from a threshold voltage of the second switching device to the power source voltage.

* * * * *